US009988127B2

(12) United States Patent
Jain et al.

(10) Patent No.: US 9,988,127 B2
(45) Date of Patent: Jun. 5, 2018

(54) VESSEL HAVING A RETRACTABLE CURSOR FRAME ASSEMBLY

(71) Applicant: Keppel Offshore & Marine Technology Centre Pte Ltd, Singapore (SG)

(72) Inventors: Amit Jain, Singapore (SG); Anis Altaf Hussain, Singapore (SG); Aziz Amirali Merchant, Singapore (SG)

(73) Assignee: Keppel Offshore & Marine Technology Centre Pte Ltd., Singapore (SG)

( * ) Notice: Subject to any disclaimer, the term of this patent is extended or adjusted under 35 U.S.C. 154(b) by 0 days. days.

(21) Appl. No.: 15/316,109

(22) PCT Filed: Apr. 10, 2015

(86) PCT No.: PCT/SG2015/050067

§ 371 (c)(1),
(2) Date: Dec. 2, 2016

(87) PCT Pub. No.: WO2016/163949

PCT Pub. Date: Oct. 13, 2016

(65) Prior Publication Data

US 2017/0096194 A1 Apr. 6, 2017

(51) Int. Cl.
*G10K 11/00* (2006.01)
*B63B 27/14* (2006.01)
(Continued)

(52) U.S. Cl.
CPC ..... *B63B 27/146* (2013.01); *B63B 27/08* (2013.01); *B63B 27/16* (2013.01);
(Continued)

(58) Field of Classification Search
CPC ..... B63B 27/36; B66C 13/02; E21B 41/0014
(Continued)

(56) References Cited

U.S. PATENT DOCUMENTS 1,200,986 A * 10/1916 Richter ..... B63B 23/04 114/366
1,587,979 A * 6/1926 Nelson ..... B63B 23/32 114/366
(Continued)

FOREIGN PATENT DOCUMENTS

CA 204558 A 10/1920
DE 349144 2/1922
(Continued)

OTHER PUBLICATIONS

International Search Report and Written Opinion for International Application No. PCT/SG2015/050067, Search completed May 18, 2015, dated May 18, 2015, 7 Pgs.
(Continued)

*Primary Examiner* — Gregory W Adams
(74) *Attorney, Agent, or Firm* — Klein, O'Neill & Singh, LLP

(57) ABSTRACT

This invention relates to a vessel having an extendable and retractable cursor frame assembly for deploying other vessels into a body of water. The retractable cursor frame assembly on the main vessel may be retracted and secured on a module of the main vessel as the main vessel is in transit. When another vessel is to be deployed into the body of water from the main vessel, the cursor frame assembly is then extended into the body of water to facilitate the launch of the other vessel.

9 Claims, 6 Drawing Sheets

(51) Int. Cl.
*B63B 27/08* (2006.01)
*B63B 27/16* (2006.01)

(52) U.S. Cl.
CPC ... *B63B 2027/148* (2013.01); *B63B 2027/165* (2013.01); *B63B 2708/00* (2013.01)

(58) Field of Classification Search
USPC ..... 114/258, 259, 366, 375, 382, 48; 187/226, 234, 409; 405/3; 414/143.2, 414/471, 545
See application file for complete search history.

(56) References Cited

U.S. PATENT DOCUMENTS 3,168,955 A * 2/1965 Black ..... B63B 27/36 114/366
3,536,023 A * 10/1970 Bascom ..... B63B 27/36 114/259
3,993,011 A * 11/1976 Garland ..... B63B 27/36 114/210
4,067,412 A 1/1978 Jackson
4,442,922 A * 4/1984 Johannson ..... B66F 9/186 182/62.5
4,638,886 A * 1/1987 Marietta ..... B66F 7/04 187/207
5,131,502 A 7/1992 Sermi
5,456,197 A * 10/1995 Kwok ..... B63B 35/32 114/382
5,628,583 A * 5/1997 Gibson ..... B63C 3/06 114/48
6,085,683 A * 7/2000 French ..... G10K 11/006 114/258
6,591,770 B1 * 7/2003 Blackmore ..... B63B 27/36 114/259
7,281,608 B2 * 10/2007 Hansl ..... B65G 1/0407 187/226
8,056,492 B2 * 11/2011 Roodenburg ..... B63B 23/34 114/268
8,215,889 B2 * 7/2012 Davis ..... B63C 11/52 114/258
2010/0101477 A1 4/2010 Davis

FOREIGN PATENT DOCUMENTS

DE 3317433 11/1984
FR 1245836 11/1960
KR 2020140006039 U 12/2014
WO WO -8303815 A1 * 11/1983 ..... B63B 27/36

OTHER PUBLICATIONS

Extended European Search Report from EPO dated Feb. 13, 2018 for EP Application No. EP15888631.7.

* cited by examiner

VESSEL HAVING A RETRACTABLE CURSOR FRAME ASSEMBLY

CROSS REFERENCE TO RELATED APPLICATIONS

This application claims is a national stage of Application No. PCT/SG2015/050067 filed on Apr. 10, 2015, the disclosure of which is hereby incorporated by reference in its entirety.

FIELD OF THE INVENTION

This invention relates to a vessel having an extendable and retractable cursor frame assembly for deploying other vessels into a body of water. More particularly, this invention relates to a retractable cursor frame assembly on a main vessel that is retracted and secured on a module of the main vessel as the main vessel is in transit. When another vessel is to be deployed into an adjacent body of water from the main vessel, the cursor frame assembly is then extended into the body of water to facilitate the launch of the other vessel.

PRIOR ART

When exploration takes place under semi-hazardous conditions such as at deep depths ocean or at offshore locations, Remotely Operated Vehicles (ROVs) are typically utilized to gain access to the particular site or location. ROVs may be used for servicing vessels out at sea and for completion of a variety of different underwater tasks. These ROVs are typically self-propelled and usually include a variety of linkages to allow activities such as the retrieval of equipment to be accomplished. ROVs are also typically provided with video recording equipment and lighting to allow the controller of the ROV to better manipulate the ROV so that the ROV may accomplish its tasks underwater.

Out at sea, ROVs are frequently deployed using tether and winch systems. A tether and winch system may include a cage or a carriage for carrying the ROV inside or a top hat type carriage with the ROV stored below. The carriage with the ROV is then lowered from a main vessel into the sea using the winch system. When the carriage reaches the surface of sea, the ROV disengages from the carriage and is then directed by the controller to the work site. To facilitate the operation of the ROV underwater, the ROV is usually tethered to the main vessel via a long cable. Through this cable, the ROV will receive power and signals transmitted from the main vessel to the ROV.

Such a deployment system may only be utilized in calm weather conditions. In bad weather conditions whereby there are stormy seas, strong winds and rough waves, such a deployment system may not be used as the carriage together with the ROV would be tossed and spun around as the carriage is winched into the sea. Under such conditions, a cursor frame assembly is usually utilized to deploy the ROV into the sea. For most vessels, the cursor frame would be attached to a side of the vessel's hull from the main deck down to a keel line of the vessel. When the ROV is to be deployed, the ROV will be placed into a carriage connected to the cursor frame. A winch or crane will then be used to lower the carriage and the ROV contained within into the sea. As the carriage is only able to move along the direction of the cursor frame, the carriage will be able to safely deploy the ROV into the sea even under the roughest sea conditions due to the restricted vertical movement of the carriage. When the cursor frame is not in use or when the vessel is in transit, the cursor frame has to be removed from the hull of the vessel. This is because the transit speed of the vessel is severely reduced if the cursor frame remains attached to the hull. For example, a normal transit speed of a vessel is between 12 to 14 knots. With the cursor frame attached to the hull, the vessel will typically be restricted to a transit speed of 3.5 knots. Any increase in the transit speed of the vessel would result in the cursor frame becoming detached from the hull of the vessel. To remove the cursor frame, rig cranes provided on the hull of the vessel are usually deployed to lift the cursor frame and place the cursor frame on the deck of the vessel. The problem with this is that as the cursor frame is quite long and bulky; the frame would occupy a substantial area of valuable deck space on the vessel.

Shortage of deck space is a problem commonly faced by offshore drilling rigs, as the amount of deck space that is made available for such systems is usually quite limited. Furthermore, in addition to the primary ROV, most vessels would tend to have a replacement ROV on-board the vessel. This is so that in the event the primary ROV faces technical difficulties, the replacement ROV may be utilized in its place. The downside to having an additional ROV on-board is that the replacement unit would also take up additional deck space on the main vessel.

Existing ROV deployment systems are disadvantageous because such systems are inefficient, bulky, and unsafe to use in bad weather and/or occupy valuable deck space when disconnected from the hull of the vessel. Hence, those skilled in the art are constantly looking for ways to devise a cursor frame for a vessel that need not be disconnected from the vessel when the vessel is in transit, inherently safe to use in all weather conditions and addresses the problems faced by existing deployment systems.

SUMMARY OF INVENTION

The above and other problems in the art are solved and an advance in the art is made in accordance with this invention. A first advantage of a vessel having an extendable and retractable cursor frame assembly in accordance with this invention is that the cursor frame need not be disconnected from the vessel when the vessel is in transit. This frees up valuable space on the deck of the vessel. A second advantage of the cursor frame assembly in accordance with this invention is that the cursor frame may be used to deploy ROVs even in bad weather conditions. A third advantage of the cursor frame assembly in accordance with this invention is that the frame assembly's guide rails are engaged in a secure and firm manner with their respective tracks due to the manner in which the C-shaped guide rails slidingly engage with the T-shaped tracks.

In accordance with embodiments of the invention, a vessel having an extendable and retractable cursor frame assembly comprises a first track and a second track wherein each track has a base portion and a blade portion protruding from the base portion. For each track, an upper half of the track is attached to a module provided on a hull of the vessel via the blade portion of the track and a lower half of the track is attached to the hull of the vessel via the blade portion of the track. The cursor frame assembly also comprises a first C-shaped guide rail that slidingly engages the first track and a second C-shaped guide rail that slidingly engages the second track. The first C-shaped guide rail has a length that is shorter than a length of the first track and the second C-shaped guide rail has a length that is shorter than a length of the second track. Further, the assembly also comprises a first fastening structure provided on the module adjacent a first end of the first track for securing the first C-shaped guide rail, and a second fastening structure provided on the module adjacent a first end of the second track for securing the second C-shaped guide rail. A first brace provided at a second end of the first track for buffering the first C-shaped guide rail and a second brace provided at a second end of the second track for supporting the second C-shaped guide rail is also included in the cursor frame assembly. In accordance with embodiments of the invention, the length of the first and second C-shaped guide rails are equal to the height of the module on the hull of the vessel.

In accordance with embodiments of the invention the first fastening structure includes a first bracket provided at a first side of the first end of the first track, and a second bracket provided at a second side of the first end of the first track. The fastening structure also includes a securing member for passing through the first and second brackets and an opening provided at a first end of the first C-shaped guide rail to secure the first C-shaped guide rail to the module.

In accordance with embodiments of the invention, the second fastening structure includes a third bracket provided at a first side of the first end of the second track, and a fourth bracket provided at a second side of the first end of the second track. The fastening structure also includes a securing member for passing through the third and fourth brackets and an opening provided at a first end of the second C-shaped guide rail to secure the second C-shaped guide rail to the module.

In accordance with embodiments of the invention, the vessel further includes a winch provided on an upper surface of the module for raising or lowering the first and second C-shaped guide rails. In embodiments of the invention, the winch may be of a constant tension type winch.

In accordance with embodiments of the invention, the frame assembly includes a first crosspiece that connects the first C-shaped guide rail to the second C-shaped guide rail, the first crosspiece being provided such that the first crosspiece is perpendicular to the first and second C-shaped guide rails. In accordance with further embodiments of the invention, the frame assembly includes a second crosspiece that connects the first C-shaped guide rail to the second C-shaped guide rail, the second crosspiece being provided such that the second crosspiece is parallel to the first crosspiece. In accordance with yet further embodiments of the invention, the frame assembly comprises a third crosspiece that connects the first C-shaped guide rail to the second C-shaped guide rail, whereby a first end of the third crosspiece is connected to an end of the first crosspiece that is connected to the first C-shaped guide rail and a second end of the third crosspiece is connected to an end of the second crosspiece that is connected to the second C-shaped guide rail.

In accordance with embodiments of the invention, the frame assembly comprises a carriage for receiving a remotely operated vehicle, a first carriage guide for connecting a first frame of the carriage to the first C-shaped guide rail, and a second carriage guide for connecting a second frame of the carriage to the second C-shaped guide rail.

BRIEF DESCRIPTION OF THE DRAWINGS

The above advantages and features of a method and apparatus in accordance with this invention are described in the following detailed description and are shown in the drawings.

DETAILED DESCRIPTION

This invention relates to a vessel having an extendable and retractable cursor frame assembly for deploying other vessels into a body of water. More particularly, this invention relates to a retractable cursor frame assembly on a main vessel that is retracted and secured on a module of the main vessel when the main vessel is in transit. When another vessel is to be deployed into an adjacent body of water from the main vessel, the cursor frame assembly is then extended into the body of water to facilitate the launch of the other vessel.

Figure 1:
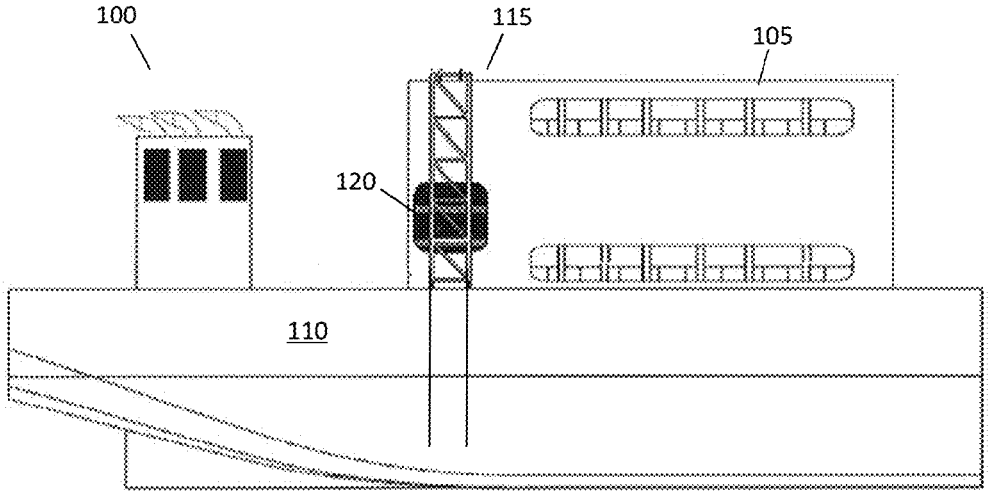
FIG. 1 illustrating a side view of a vessel having a cursor frame in accordance with an embodiment of this invention whereby guide rails of the cursor frame are in a retracted position.

FIG. 1 illustrates a vessel having an extendable and retractable cursor frame assembly in accordance with an embodiment of the invention. Vessel 100 includes hull 110 and module 105 which are provided on an upper surface of hull 110, or on the deck of vessel 100. One skilled in the art will recognize that module 105 may be any type of module that may be installed on the deck of vessel 100 such as, but not limited to, a mud module, a storage module or an accommodation module without departing from the invention. In accordance with an embodiment of the invention, vessel 100 may comprise a drill ship while module 105 may comprise a mud module. The mud module on the drill ship is used to house drilling consumables such as mud, drill water, fuel, oil, Barite and bentonite and/or mud systems such as mud tanks, mud pumps, mixing or charging pumps. In conventional drill ships, drilling consumables and/or mud systems are normally housed within the hull of the drill ship.

The downside of doing this is that once the drilling consumables have been depleted, the draft of the drill ship will change as the load within the drill ship varies.

In this embodiment of the invention, as the drilling consumables and/or mud systems are all housed within the mud module, this frees up tank space within the hull of the drill ship for carrying additional ballast water. The additional ballast water provided within the tanks in the hull of the drill ship assist in maintaining the draft of the drill ship at a constant level, even after all the drilling consumables have been exhausted. This increased stability means that the drill ship is able to stay out at sea for a longer period.

As illustrated in FIG. 1, module 105 is provided with opening 120 that is provided adjacent a deck of vessel 100. Opening 120 may be used to gain access from and to module 105. In embodiments of the invention, opening 120 may be sufficiently large to allow a carriage having a ROV contained within to pass through. FIG. 1 also illustrates cursor frame assembly 115 that has an upper section that is attached to module 105 and a lower section that is attached to hull 110.

Figure 2:
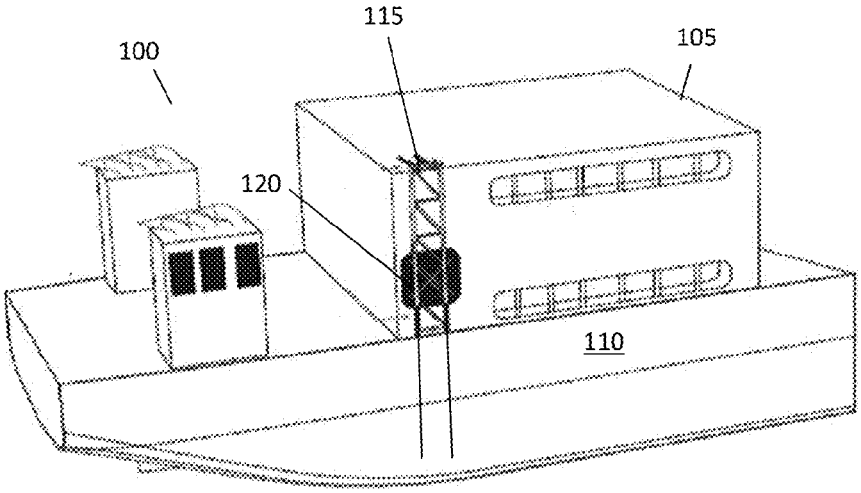
FIG. 2 illustrating a perspective view of a vessel having a cursor frame in accordance with an embodiment of this invention whereby guide rails of the cursor frame are in a retracted position.
Figure 3:
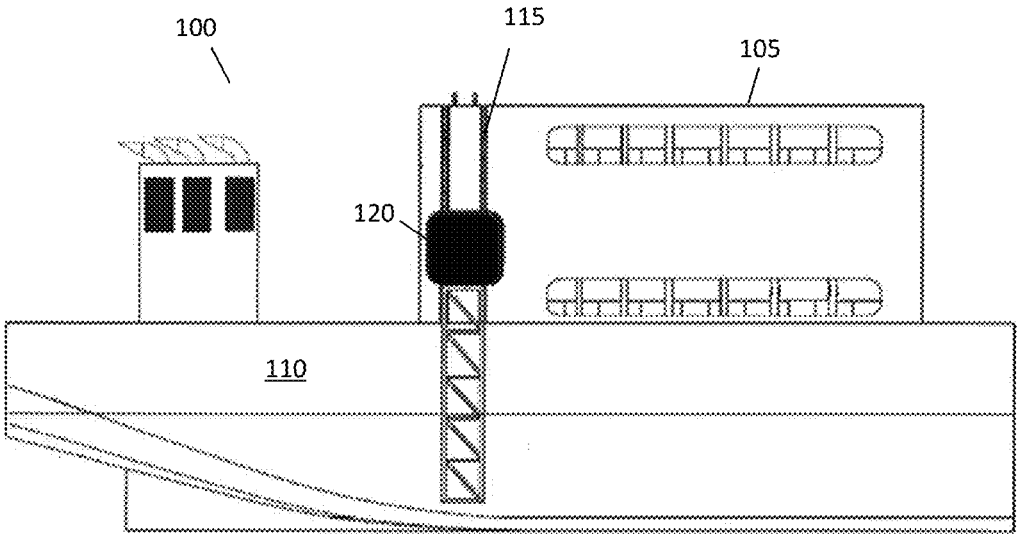
FIG. 3 illustrating a side view of a vessel having a cursor frame in accordance with an embodiment of this invention whereby guide rails of the cursor frame are in a deployed position.
Figure 4:
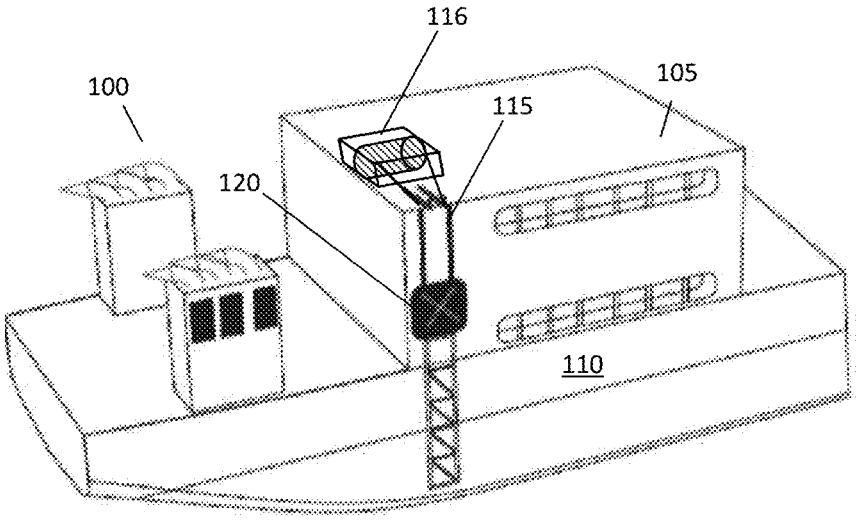
FIG. 4 illustrating a perspective view of a vessel having a cursor frame in accordance with an embodiment of this invention whereby guide rails of the cursor frame are in a deployed position.

When vessel 100 is in transit, cursor frame assembly 115 will be in a retracted position, as illustrated in FIGS. 1 and 2. In this retracted position, the guide rails of cursor frame assembly 115 will be retracted out of the water and secured to module 105 using fastening structures or devices. When a ROV is to be deployed from vessel 100, cursor frame assembly will be in a deployed position, as illustrated in FIGS. 3 and 4. In this extended position, the guide rails of cursor frame assembly 115 will extend past a keel level of vessel 100 into an adjacent body of water. This facilitates the deployment of a carriage having a ROV contained within, from opening 120 of module 105 into an adjacent body of water such as the ocean. An advantage of having such a retractable and extendable cursor frame assembly is that when vessel 100 is in transit, frame assembly 115 may be retracted above the water level and securely fastened to the side of module 105 thereby allowing vessel 100 to achieve higher transit speeds. If guide rails of frame assembly 115 were to be left extended in the body of water, the transit speed of vessel 100 would be severely limited. This is because vessel 100 would have to transit at lower speeds to prevent the extended guide rails of frame assembly 115 from being torn out from their attachments as vessel 100 sails across the ocean.

Figure 5A:
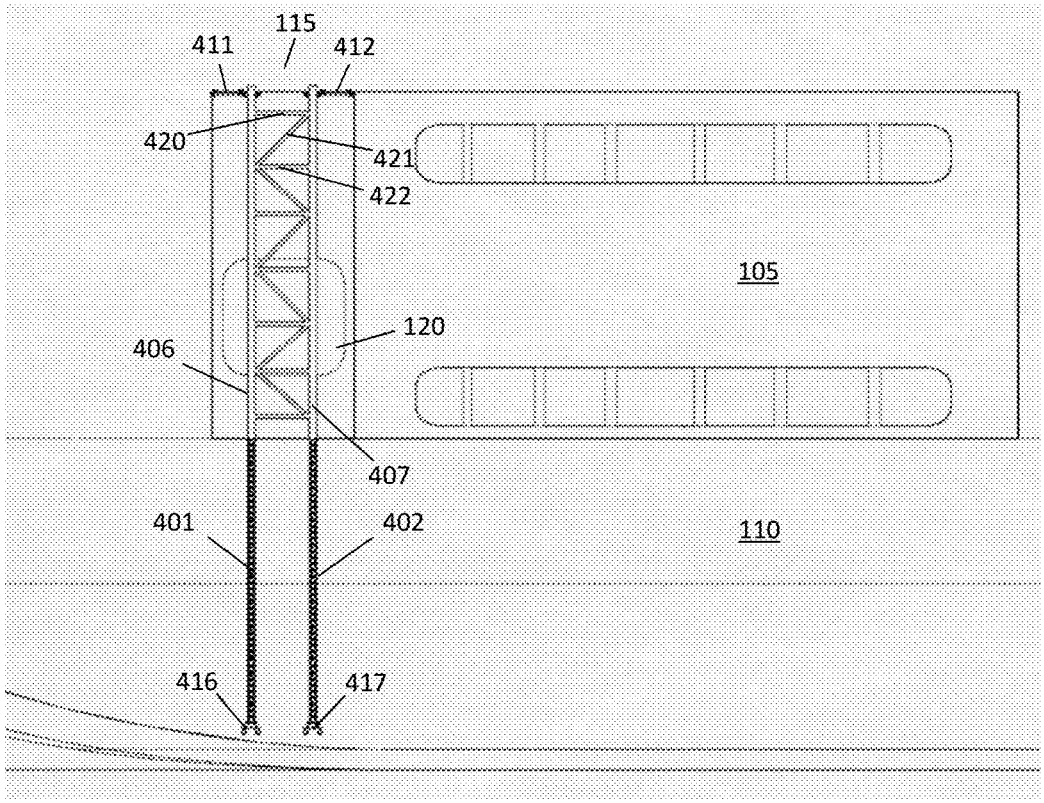
FIG. 5*a* illustrating a cursor frame assembly in a retracted position in accordance with an embodiment of this invention.

FIG. 5*a* illustrates a detailed diagram of cursor frame assembly 115. As illustrated in FIG. 5*a*, cursor frame assembly 115 includes tracks 401 and 402 that extend from the top of module 105 down to a keel level of hull 110 past opening 120. In other words, an upper part of track 401 and track 402 are attached to module 105 while a lower part of track 401 and track 402 are attached to hull 110. Tracks 401 and 402 may be attached to module 105 and hull 110 using a variety of methods, either by being welded or nailed to module 105 and/or hull 110. Cursor frame assembly 115 also include guide rails 406 and 407 that slidingly engage with tracks 401 and 402 respectively. In other words, guide rails 406 and 407 are arranged such, so that these guide rails are able to slide along the entire length of tracks 401 and 402. In accordance with embodiments of the invention, the upper part of tracks 401, 402 extend from the top of module 105 to the top of opening 120 while the lower part of tracks 401, 402 extend vertically downwards from the bottom of opening 120 to the keel of vessel 100, across hull 110. In other words, tracks 401 and 402 do not extend across the hatch or door of opening 120.

FIG. 5*a* also illustrates that the length of guide rail 406 is shorter than the total length of track 401, and the length of guide rail 407 is shorter than the total length of track 402. This is so that guide rails 406 and 407 may retract along tracks 401 and 402 when not in use and may extend downwardly along these tracks when a ROV is to be deployed from opening 120. In embodiments of the invention, the length of guide rails 406 and 407 are designed such, so that the length of these guide rails are equal to the height of module 105 on vessel 100. This is to ensure that when the guide rails are retracted, no part of the guide rails would be positioned lower than the deck of vessel 100 thereby reducing the possibility that the ocean's surface would come into contact with the guide rails as vessel 100 is in transit.

Tracks 401 and 402 are further provided with braces 416 and 417 respectively at their lower ends. When guide rails 406 and 407 are fully deployed, braces 416, 417, will support these guide rails. In the event guide rails 406 and 407 are accidently deployed from the top of module 105, braces 416 and 417 will provide support for guide rails 406 and 407. This ensures that these free-falling guide rails will not damage other parts of the vessel 100. For example, if the winch or crane 116 that is used to lower these guide rails were to snap, these braces would prevent the guide rails from falling into the ocean below.

Fastening structures 411 and 412, which are provided near an upper section of module 105, are used to hold guide rails 406 and 407 in place when guide rails 406 and 407 are in a retracted position. The main reason why fastening structures 411 and 412 are positioned at the upper section of module 105 is so that operators of cursor frame assembly system 115 may have easier access to operate these fastening structures. Furthermore, as guide rails 406 and 407 are typically raised or lowered using either a crane or a winch 116 provided at the upper surface of module 105, there would usually be an operator position adjacent the crane or winch 116 who would then fasten guide rails 406 and 407 in place using fastening structures 411 and 412 respectively.

As illustrated in FIG. 5*a*, guide rail 406 is connected to guide rail 407 via crosspiece 420. In particular, crosspiece 420 is connected in such a manner that crosspiece 420 is perpendicular to both guide rails 406 and 407. In harsh environmental conditions, strong torque forces and strong bending forces act against guide rails 406 and 407 as these guide rails are in an extended position; causing these guide rails to twist and turn, straining the connection between the guide rails and their respective tracks. Crosspiece 420, which is perpendicular to both guide rails 406 and 407, is able to absorb the torque and bending forces acting on guide rails 406 and 407 thereby allowing cursor frame assembly 115 to be utilized or fully extended even under the harshest weather conditions. One skilled in the art will recognize that crosspiece 420 does not have to be exactly 90° to both guide rails 406 and 407. As long as crosspiece 420 is substantially perpendicular to both guide rails 406 and 407, crosspiece 420 would be able to perform its function of distributing the torque forces.

In embodiments of the invention, cursor frame assembly 115 may have more than one crosspiece connecting guide rails 406 and 407. Such an additional crosspiece is illustrated in FIG. 5*a* as crosspiece 422. One skilled in the art will recognize that any number of such crosspieces may be used to connect guide rail 406 to guide rail 407 provided that these crosspieces are connected such that they are perpendicular or substantially perpendicular to both guide rails 406 and 407. In accordance with further embodiments of the invention, a further crosspiece may be provided to further distribute the application of strong torque and bending forces on guide rails 406 and 407. In particular, a crosspiece may be connected to an end of crosspiece 420 that is connected to guide rail 407 while another end of this same crosspiece may be connected to an end of crosspiece 422 that is connected to guide rail 406. Such a crosspiece is illustrated in FIG. 5*a* as crosspiece 421. Crosspiece 421 assists in the absorption of vertical forces that may be applied to crosspieces 420 and 422 thereby ensuring that the structure and integrity of these two parallel crosspieces will not be jeopardized under the harshest operating conditions. Although reference is only made to crosspieces 420-422, one skilled in the art will recognize that any number or combination of these three crosspieces may be used across the length of cursor frame assembly 115 without departing from this invention.

In accordance with further embodiments of the invention, the stability and handling of cursor frame assembly 115 may be improved by selecting crosspieces with rectangular cross-sections. By selecting rectangular shaped crosspieces, this effectively provides cursor frame assembly 115 with a more stable base to withstand bending forces that may be applied to the guide rails and tracks when the guide rails are extended in rough weather conditions. This is because such a shape would encourage the even distribution of torque forces across the guide rails by the crosspieces thereby preventing cursor frame assembly 115 from being structurally damaged.

Figure 5B:
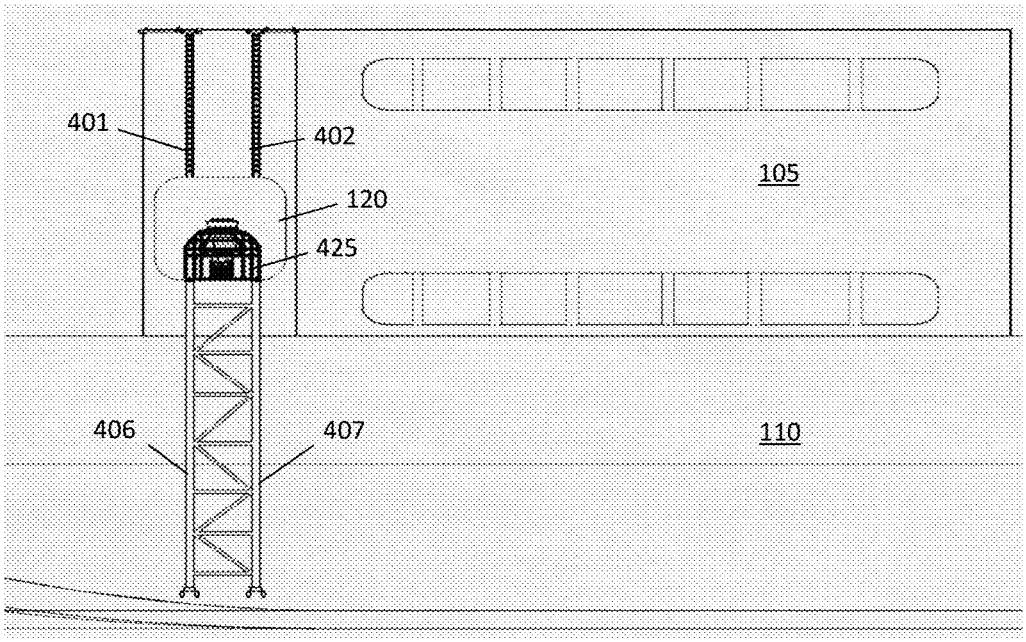
FIG. 5*b* illustrating a cursor frame assembly in an extended position before a carriage with a ROV contained within is moved onto the cursor frame assembly in accordance with an embodiment of this invention.

When the cursor frame is not in use, or when guide rails 406 and 407 are in a retracted position, a carriage for receiving a ROV and the ROV itself will be located within module 105. An example of such a carriage is illustrated in FIG. 5*b* as carriage 425. Carriage 425 may comprise a cursor that is wholly fabricated from stainless steel and the cursor may be in the shape of an upside down bowl or a bird-cage whereby the upper curved portion of the cursor encompasses the ROV.

In operation, carriage 425 will only be attached to guide rails 406, 407 after these guide rails have been extended into the ocean and after the hatch across opening 120 has been removed. In accordance with embodiments of the invention, a ROV that is to be deployed into the ocean is first loaded into carriage 425. An A-frame is then utilized to manoeuvre carriage 425 together with the ROV from the interior of module 105 onto guide rails 406, 407. Once carriage 425 has been manoeuvred into position over these guide rails, the A-frame will lower carriage 425 onto guide rails 406, 407 so that attachments provided at the sides of carriage 425 may engage with these guide rails. Once the attachments on carriage 425 have securely engaged with the guide rails, the A-frame will then continue to lower carriage 425 into the ocean. Carriage 425 will travel along a constrained path along guide rails 406, 407 thereby ensuring that carriage 425 will not freely sway against hull 110 even though vessel 100 may be violently heaving and/or rocking or even if carriage 425 is being buffeted by rough winds throughout this entire process.

Once the A-frame has lowered carriage 425 into the ocean, the ROV contained within carriage 425 may then be deployed to carry out its underwater operations. The A-frame will then raise empty carriage 425 from the ocean by raising carriage 425 upwards along guide rails 406, 407 until carriage 425 is lifted off the top of these guide rails. The disengaged carriage is then manoeuvred back into the interior of module 105 for storage until the ROV has completed its underwater operations. When the ROV has completed its drilling operations, carriage 425 will then be lowered into the ocean as previously described. The ROV will then dock with carriage 425 and carriage 425 together with the ROV will be raised from the ocean using the A-frame. After the A-frame has lifted carriage 425 from the guide rails, the carriage together with the ROV is then moved into the interior of module 105 for storage.

Figure 6:
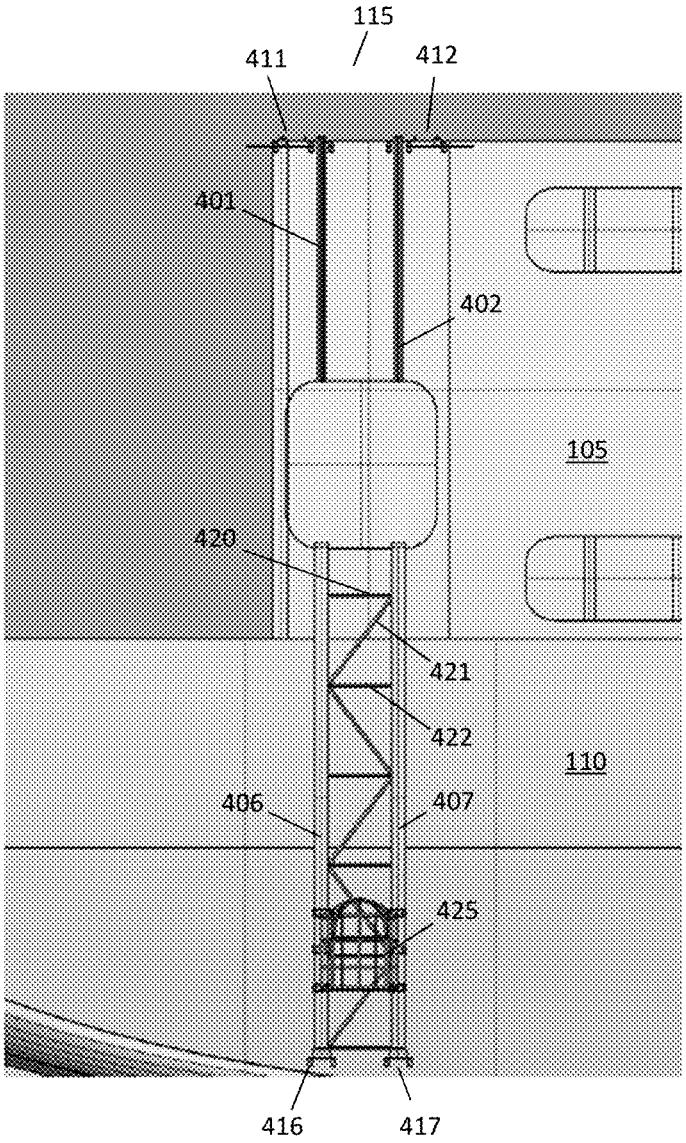
FIG. 6 illustrating a cursor frame assembly in an extended position after the ROV has been deployed from the carriage in accordance with an embodiment of this invention.

FIG. 6 illustrates cursor frame assembly 115 whereby guide rails 406 and 407 are fully extended and after carriage 425 has deployed the ROV. When guide rails 406 and 407 of cursor frame assembly 115 are fully extended, carriage 425 would be positioned near a keel level of vessel 100 or just under the surface of the ocean. This facilitates the deployment of a ROV from carriage 425 into the ocean. Even if the sea conditions were rough and choppy, and even if there were strong gusts of wind, the ROV would still be able to launch from carriage 425 as carriage 425 would be held firm by cursor frame assembly 115.

Figure 7:
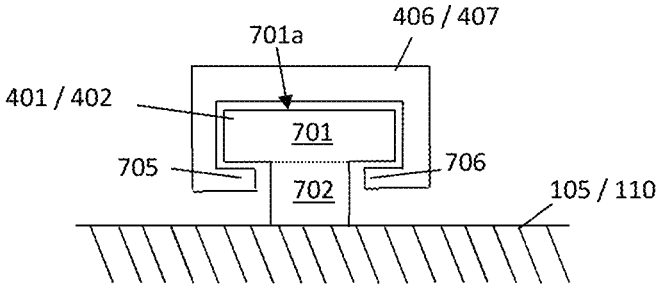
FIG. 7 illustrating a cross sectional view of a guide rail engaged with a track in accordance with an embodiment of this invention.

FIG. 7 illustrates an enlarged cross-sectional view of C-shaped guide rail 406 and its corresponding track 401. As shown, track 401 comprises wider base portion 701 and narrower blade portion 702 that protrudes from base portion 701. This results in track 406 having a "T-shaped" cross-sectional structure. For an upper half of track 401, blade portion 702 is the section of track 401 that is attached to module 105 and as for the lower half of track 401; blade portion 702 is the section of track 401 that is attached to part of module 105 and part of hull 110. Due to the manner in which C-shaped guide rail 406 slidingly engages with T-shaped track 401, the movement of guide rail 406 is restricted to only sliding movements along the length of track 401. Base portion 701 of track 401 engages with the sides of guide rail 406 thereby preventing guide rail 406 from moving horizontally with respect to track 401. Similarly, edges 705 and 706 of guide rail 406 engage with base portion 701 to prevent guide rail 406 from moving away from surface 701*a* of base portion 701.

Track 402 will also have a wider base portion and a narrower blade portion that protrudes from its base portion. An upper half of track 402 will be attached to module 105 via blade portion 702, and a lower half of track 402 will be attached to part of module 105 and part of hull 110 via blade portion 702. Due to the manner in which C-shaped guide rail 407 slidingly engages with track 402, the movement of guide rail 407 is restricted to only sliding movements along the length of track 402. The base portion of track 402 engages with the sides of guide rail 407 thereby preventing guide rail 407 from moving horizontally with respect to track 402. Similarly, the edges of guide rail 407 engage with the base portion of track 402 to prevent guide rail 407 from moving away from a surface of the base portion that face guide rail 407. The configurations described above ensure that the guide rails are securely attached to their respective tracks. This allows cursor assembly 115 to be utilized even in rough weather as the movement of the guide rails are restricted to only sliding movements along their respective tracks.

Figure 8:
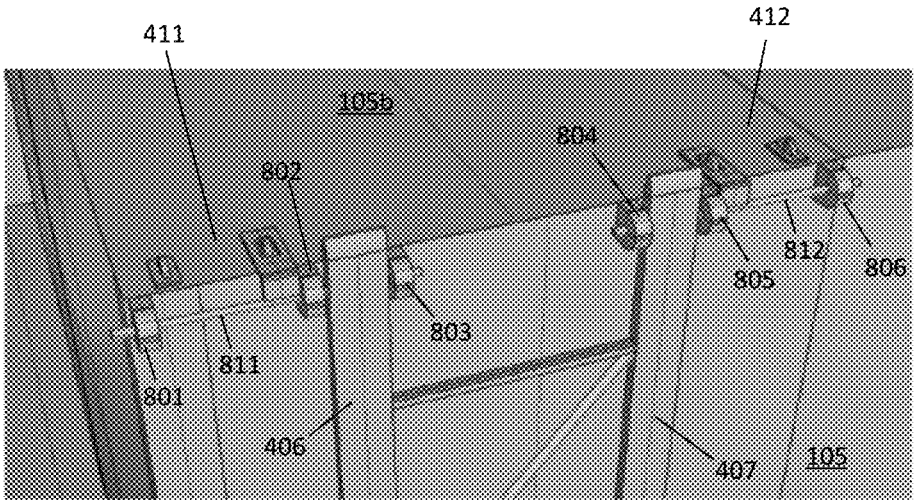
FIG. 8 illustrating fastening structures in accordance with an embodiment of this invention.

FIG. 8 illustrates an enlarged view of fastening structures 411 and 412. In particular, fastening structure 411 includes brackets 801, 802 and 803 that are attached to module 105. As illustrated in FIG. 8, bracket 803 is provided on one side of guide rail 406, bracket 802 is provided on an opposing side of guide rail 406 while bracket 801 is provided the furthest away from guide rail 406. Fastening structure 411 also includes securing member 811 that is provided with a latch. Securing member 811, which passes through brackets 801-803 and an opening in guide rail 406, is used to hold guide rail 406 in place when guide rail 406 is in a retracted position. In this position, the latch that is attached to securing member 811 will be attached to a connector on upper surface 105*b* to prevent securing member 811 from further movement. When guide rail 406 is to be extended, securing member 811 will be withdrawn from bracket 803 and the opening in guide rail 406 thereby allowing guide rail 406 to be lowered down along the length of track 401.

Similarly, as illustrated in FIG. 8, fastening structure 412 comprises brackets 804, 805 and 806 that are attached to module 105. As can be seen, bracket 804 is provided on one side of guide rail 407, bracket 805 is provided on an opposing side of guide rail 407 while bracket 806 is provided the furthest away from guide rail 407. Fastening structure 412 also includes securing member 812 that is provided with a latch. Securing member 812, which passes through brackets 804-806 and an opening in guide rail 407, is used to hold guide rail 407 in place when guide rail 407 is in a retracted position. In this position, the latch that is attached to securing member 812 will be attached to a connector on upper surface 105*b* to prevent securing member 812 from any further movement. When guide rail 407 is to be extended, securing member 812 will be withdrawn from bracket 804 and the opening in guide rail 407 thereby allowing guide rail 407 to be lowered down along the length of track 402. In embodiments of the invention, securing members 811 and 812 may be a metal or steel rod that has sufficient structural strength to support the weight of guide rails 406 and 407 respectively.

Figure 9:
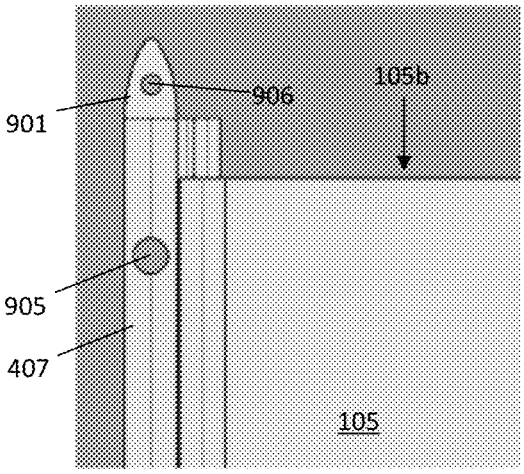
FIG. 9 illustrating a side view of a fastening structure in accordance with an embodiment of this invention.

FIG. 9 illustrates a side view of guide rail 407. This side view illustrates pad-eye 901 and opening 905 that are both provide near an upper end of guide rail 407. Pad-eye 901 is provided with opening 906, which is used for receiving a hook or a device for connecting pad-eye 901 to a winch or a crane. As for opening 905 at guide rail 407, this opening is used to receive securing member 812 when guide rail 407 is to be secured in a retracted position. Similarly, although it is not illustrated in FIG. 9, guide rail 406 is also provided with a pad-eye and an opening for receiving securing member 811. The pad-eye provided at guide rail 406 would also have an opening for receiving a device for connecting the pad-eye to the winch or crane. The winch or crane that is connected to guide rails 406 and 407 would typically be provided on surface 105*b* and is used to raise or lower guide rails 406 and 407 as required. In embodiments of the invention, the winch provided on surface 105*b* for raising or lowering the guide rails may be of a constant tension type. This means that the winch may maintain the wire connected to the guide rails at a constant tension thereby controlling the speed at which the guide rails are being lowered. This is advantageous for safety reasons as this ensures that the guide rails may not be lowered at more than a particular speed.

Figure 10:
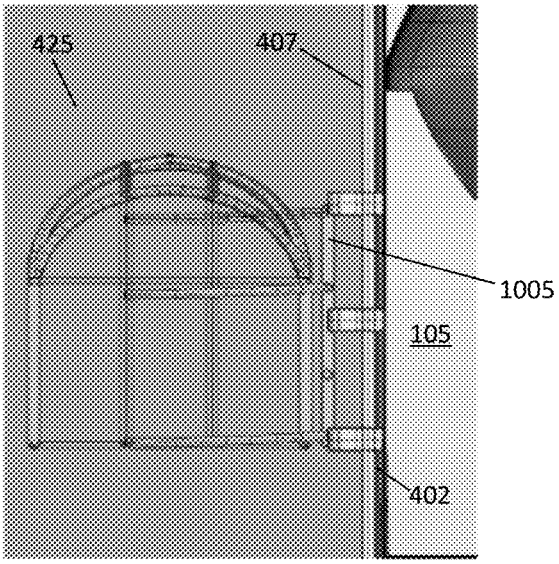
FIG. 10 illustrating a side view of a carriage in accordance with an embodiment of this invention.
Figure 11:
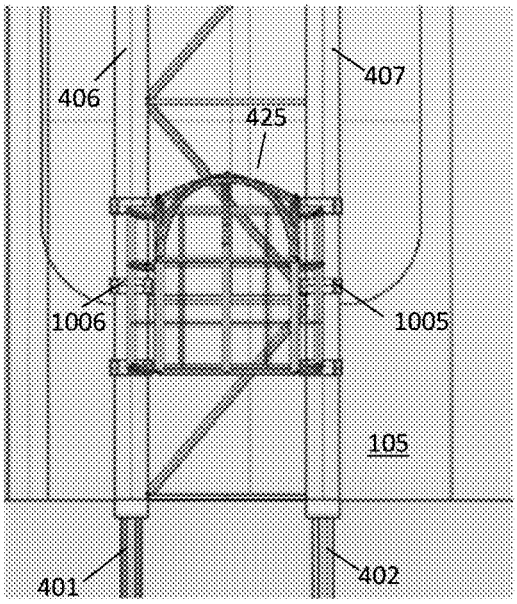
FIG. 11 illustrating a front view of a carriage in accordance with embodiment of this invention.

FIG. 10 illustrates a side view of carriage 425 and FIG. 11 illustrates the frontal view of carriage 425. Connecting device 1005, which is provided on one side of carriage 425, is used to slidingly engage with guide rail 407 when carriage 425 is lowered onto guide rail 407. Similarly, connecting device 1006, which is provide on the other side of carriage 425, is used to slidingly engage with guide rail 406 when carriage 425 is lowered onto guide rail 406. In accordance with embodiments of the invention, connecting devices 1005, 1006 may comprise carriage guides or any other type of similar structures.

The above is a description of a vessel having an extendable and retractable cursor frame assembly. It is foreseen that those skilled in the art can and will design alternative embodiments of this invention as set forth in the following claims.

What is claimed is:

1. A vessel having an extendable and retractable cursor frame assembly comprising:

a first track and a second track, each track having a base portion and a blade portion protruding from the base portion, wherein for each track, an upper half of the track is attached to a module provided on a hull of the vessel via the blade portion of the track and a lower half of the track is attached to the hull of the vessel via the blade portion of the track;

a first C-shaped guide rail that slidingly engages the first track and a second C-shaped guide rail that slidingly engages the second track, wherein the first C-shaped guide rail has a length that is shorter than a length of the first track and the second C-shaped guide rail has a length that is shorter than a length of the second track;

a first fastening structure provided on the module adjacent a first end of the first track for securing the first C-shaped guide rail;

a second fastening structure provided on the module adjacent a first end of the second track for securing the second C-shaped guide rail;

a first brace provided at a second end of the first track for buffering the first C-shaped guide rail and a second brace provided at a second end of the second track for buffering the second C-shaped guide rail; and wherein the first fastening structure comprises:

a first bracket provided at a first side of the first end of the first track;

a second bracket provided at a second side of the first end of the first track;

a securing member for passing through the first and second brackets and an opening provided at a first end of the first C-shaped guide rail to secure the first C-shaped guide rail to the module.

2. The vessel according to claim 1, wherein the length of the first and second C-shaped guide rails are equal to the height of the module on the hull of the vessel.

3. The vessel according to claim 1 wherein the second fastening structure comprises:

a third bracket provided at a first side of the first end of the second track;

a fourth bracket provided at a second side of the first end of the second track;

a securing member for passing through the third and fourth brackets and an opening provided at a first end of the second C-shaped guide rail to secure the second C-shaped guide rail to the module.

4. The vessel according to claim 1 further comprising:

a winch provided on an upper surface of the module for raising or lowering the first and second C-shaped guide rails.

5. The vessel according to claim 4 wherein the winch is a constant tension type winch.

6. The vessel according to claim 1 wherein a first crosspiece connects the first C-shaped guide rail to the second C-shaped guide rail, the first crosspiece being provided such that the first crosspiece is perpendicular to the first and second C-shaped guide rails.

7. The vessel according to claim 6 wherein a second crosspiece connects the first C-shaped guide rail to the second C-shaped guide rail, the second crosspiece being provided such that the second crosspiece is parallel to the first crosspiece.

8. The vessel according to claim 7 wherein a third crosspiece connects the first C-shaped guide rail to the second C-shaped guide rail, whereby a first end of the third crosspiece is connected to an end of the first crosspiece that is connected to the first C-shaped guide rail and a second end of the third crosspiece is connected to an end of the second crosspiece that is connected to the second C-shaped guide rai.

9. The vessel according to claim 1 further comprising:

a carriage for receiving a remotely operated vehicle;

a first carriage guide for slidingly engaging a first side of the carriage to the first C-shaped guide rail; and a second carriage guide for slidingly engaging a second side of the carriage to the second C-shaped guide rail.

* * * * *